United States Patent [19]

Garnier

[11] Patent Number: 4,599,931

[45] Date of Patent: Jul. 15, 1986

[54] CONCERT HARPS

[76] Inventor: Joël Garnier, La Chappelle Saint Florent, France

[21] Appl. No.: 521,554

[22] Filed: Aug. 9, 1983

[30] Foreign Application Priority Data

Aug. 9, 1982 [FR] France ..... 82 13840

[51] Int. Cl.[4] ..... G10D 1/04; G10C 3/04

[52] U.S. Cl. ..... 84/265; 84/214

[58] Field of Search ..... 84/264–266, 84/197, 200–208, 214, 297 R

[56] References Cited

U.S. PATENT DOCUMENTS

| | | | |
|---|---|---|---|
| 2,812,681 | 11/1957 | Carron | 84/266 |
| 3,494,238 | 2/1970 | Crites | 84/266 |
| 3,739,680 | 6/1973 | Christiansen | 84/266 |
| 3,853,030 | 12/1974 | Petutschnigg | 84/200 X |

FOREIGN PATENT DOCUMENTS 2229108 6/1974 France .

*Primary Examiner*—Benjamin R. Fuller

*Attorney, Agent, or Firm*—Young & Thompson

[57] ABSTRACT

A concert harp including a mechanism for shortening the vibrating length of the strings for setting the instrument tuned scale up.

According to the invention, the stress which is immobilizing a point of string (11) in order to modify the vibrating length thereof is provided by a powered element displaceable perpendicularly to the string along a path intersecting the string substantially at the pinching point, particularly a hydraulic micro-jack (1*a*, 1*b*).

The invention simplifies the mechanism and provides a silent operation.

14 Claims, 9 Drawing Figures

CONCERT HARPS

FIELD OF THE INVENTION

The present invention relates to concert harps and more particularly to the mechanism of the concert great harp which allows, by acting on one of the seven pedals, shortening the vibrating length of the strings corresponding to the same note over the whole compass of the instrument in order to set the tuned instrument scale up. In the Erard double action concert harp, the pedals have two active positions and one rest position and they allow setting the note or a full tone or a half tone up in order to obtain the natural or the sharp.

BACKGROUND ART

Such a known mechanism includes seven pedals with three positions, mounted on the base of the instrument and resiliently returned by springs, seven draw-rods mounted on the body of the instrument and fourteen systems of rods controlling each the rotation of the forks the two prongs of which, being normally clear of the string, coming to bear against one of the strings and twisting it, thereby creating a node of vibration. A large concert harp comprises 94 forks and each system of rods is formed of a return bell-crank lever displacing the rod, connection rocker bars acting on the cranks of the forks and return rocking arms for allowing the systems of rods to be housed in the saddle between two plates of the mechanism.

The major disadvantage of such a mechanism is the complexity of its transmission of movement with a number of parts, of which some are very small, being close to a thousand. This complexity results in a high cost and a very costly repair necessitating dismounting the mechanism into pieces since all the parts have to be disassembled, and this can take up to a hundred odd hours.

A further disadvantage is the operating noise resulting from the enormous number of parts which are set in motion and from the mechanical plays due to the high torque which has to be applied simultaneously on six or seven forks in order to twist strings stretched in a sufficient manner for creating a node of vibration.

A third disadvantage is mentioned in French patent No. 2 229 108 and results from the mode of operation of the forks which impart to the strings a stress leading to an elongation and a premature wear. In fact, this disadvantage is increased due to the fact that, because of the plays, the rotation movements of the seven forks of a same system of rods are not strictly performed over the same angle and the stress of the most twisted string is necessarily higher than that which would be necessary to provide the formation of a node in order that the fork having the greatest play provides nevertheless the necessary stress on its string. The above French patent proposes to remedy this disadvantage by pinching the string instead of twisting it, but this pinching, according to a well known principle in the stringed instruments field, is not usable in practice with the mechanism presently known for the harp without introducing, for each pinch, playcatch up devices which would make the mechanism even more complex and could not be housed in the saddle.

Another disavantage of the control of the forks through a mere rotational movement around an axis perpendicular to the string is that the clearance between the string and the parts of the fork or tongs at rest remains limited and there is a risk of contact between the vibrating string and said parts resulting in a so-called "zincking" noise.

DISCLOSURE OF THE INVENTION

The object of the invention is to remedy such various disavantages by providing a more simple and easily dismountable mechanism, with a possiblility of dismounting and exchanging the mechanism of a single string only, said mechanism being perfectly silent and providing on each string a stress of fixed value, individually calibrated and stable with time.

A further object of the present invention is to provide a clamp usable in said mechanism, which does not impart to the string a torsion stress and the branches of which spread apart sufficiently when they open in order to avoid a contact with the string which is the cause of "zincking".

Moreover, the invention allows to provide a programming or a prior selection of the modulation, viz. of the change of tone of the strings of a note, the execution of the chosen modulation or the run of the program being controlled by the action of the performer on a single contactor pedal. This improvement which simplifies the performance of a piece of music was made possible only because of the new mechanism and is possible, due notably to the stresses to be applied on the strings, only with said new mechanism.

According to the invention the stress is exerted on each string by a control powered element displaceable perpendicularly to the string along a path intersecting the string substantially at the pinching point. According to the preferred embodiment the powered element comprises a hydraulic micro-jack. The substitution of a control through a driving means giving a displacement perpendicular to the string, especially through a hydraulic jack, for a mechanical drive giving a rotational displacement provides many advantages which were not a priori obvious. Further to the overall simplification of the mechanism, and the six or seven micro-jacks for the strings of the same note being connected to a single feeding channel in which the pressure is controlled by a pressurizing pedal or equivalent device, for example a hydraulic compressor, the stresses on the strings are absolutely and precisely predetermined by the sections of the micro-jack and the feeding pressure, whatever play can appear in the twisting or pinching mechanism of the string. The stress imparted to the string can be high and does not depend on the action exerted by the performer on the pedal, except when the pedal acts directly on the pressurizing pump. The mechanism is silent, the action of the hydraulic jack can be quick as well as progressive with a setting in contact under a pressure pratically nil and in any case independent of the final pressure, which avoids impacts. Moreover, the hydraulics allow to provide a programming or prior selection of the modulation.

The action of the powered element with a displacement perpendicular to the string, e.g. the piston rod of a micro-jack can result in a twist of the string, for example via a fork of known type helically displaced, or in a pinch which can be provided by a scissors-shaped jaw, the opening and closing of which are controlled by the displacement of the powered element or by a jaw including a window and a pusher-piece the parts of which are displaced in opposite directions by the displacement of the powered element. In the case of a window and pusher-piece jaw or of a scissors-shaped jaw, the two elements are preferably set in operation by displacements in symmetrical reverse directions relative to the average position of the string, thereby increasing the space between the pinching element and the string and reducing the "zincking" risk of the string. A similar result is provided in the case of a fork as, simultaneously to the rotation which moves the prongs away from the string, the fork is displaced along its axis of rotation in order to keep it clear of the string.

According to a preferential embodiment, the clamp is of the scissors type, with the two branches articulated about axes fixed at their end opposite the pinching jaw, the motion of the jaws toward and away from each other being provided by the displacement in the axial plane of a pin moved by the powered element and engaged in the oblong openings provided at the rate of one for each of the branches in the longitudinal direction of said branch.

Where the micro-jacks are fed by a hydraulic central station the pedals or elements playing a similar part which are at the disposal of the performer control a distributor which sends the pressure to the desired feeding channel of the micro-jacks. The distributor can be controlled by a programmable computer in which are stored the successive modulations of a piece of music, the passage of a modulation to another being provided by acting on a single contactor pedal.

BRIEF DESCRIPTION OF THE DRAWINGS

Further features of the invention will become more apparent from the reading of the detailed description of various embodiments thereof which is made herebelow with reference to the accompanying drawings wherein.

DESCRIPTION OF THE PREFERRED EMBODIMENTS

Figure 1:
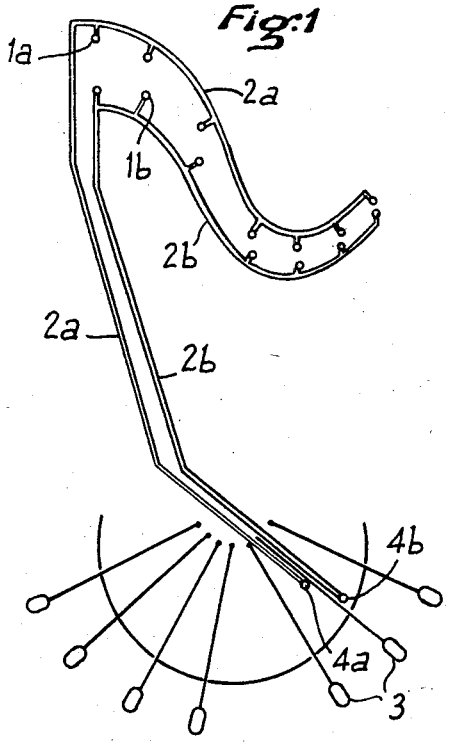
FIG. 1 is a schematic view of the control of the string jacks corresponding to a note of a concert harp according to the invention, with a hydraulic control via the pedals acting on master hydraulic cylinders.

In the drawings, reference numerals 1*a* and 1*b* designate micro-jacks and their fixation means for the corresponding string, some embodiments thereof being described in more detail with reference to FIGS. 4 through 9. With each string cooperate two such micro-jacks 1*a* and 1*b*, with which it is possible to set a note a half tone or a full tone up relative to the chord of the string. In the embodiments shown and as in the standard harp, the change of tone is provided simultaneously for all the strings corresponding to the same note, for example the seven "C" strings. The seven micro-jacks 1*a* and the seven micro-jacks 1*b* are connected to the two conduits 2*a* and 2*b*, the harp assembly comprising fourteen such channels, two of which only being shown in the drawing.

In the embodiment of FIG. 1, the seven standard pedals 3 control each two master cylinders 4*a*, 4*b* which are connected to channels 2*a* and 2*b* respectively. The performer creates the control hydraulic pressure just as he creates, in the standard harp, the mechanical force, but due to the automatic play adjustment provided by the hydraulic transmission, the forces exerted on the strings are according to predetermined ratios with the hydraulic pressure generated by the action on the pedal.

Figure 2:
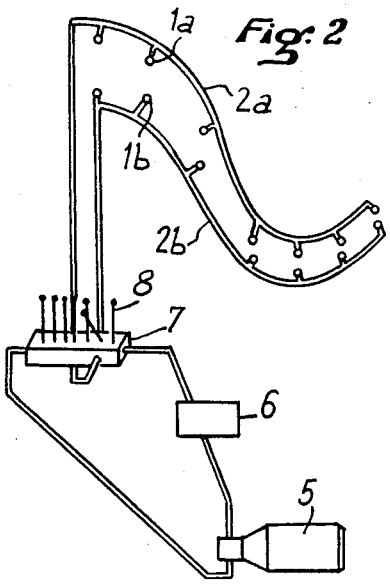
FIG. 2 is a corresponding schematic view with the cntrol provided by a manual distributor and a hydraulic central station.

In the embodiment of FIG. 2, the pressure is generated by a small hydraulic central station 5 which feeds, possibly via an accumulator 6, a distributor 7. Such a distributor is shown in FIG. 2 in the shape of a manual distributor with three position operating handles 8. It is obvious that the distributor 7 could also be controlled by pedals 3.

Figure 3:
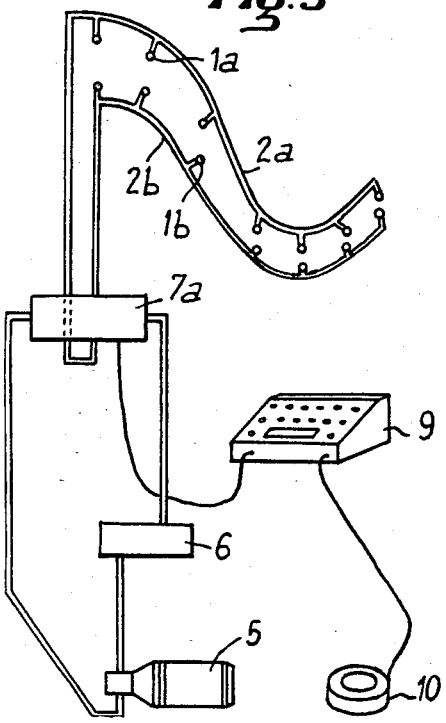
FIG. 3 is a schematic view similar to that of FIG. 2, with a programming of the modulation.

In the embodiment of FIG. 3, the same hydraulic central station 5, accumulator 6 and distributor 7*a* are used, but in this case the distributor 7*a* is formed for example of electromagnetic valves controlled by a computer 9 in which is stored by any one of the known means the temporal program of the tone modifications of the strings during a piece of music. With this embodiment, the performer controls the modulations simply by applying, with the aid of a pedal 10, a command signal to the computer 9 which in turn sends the command signal to the control valve of distributor 7*a* corresponding to the programmed note modification.

In FIGS. 4 through 9, reference numeral 11 designates a string of the harp and reference 12 the base plate of the saddle on which are mounted the hydraulic micro-jacks and the string immobilization devices which they control.

Figure 4:
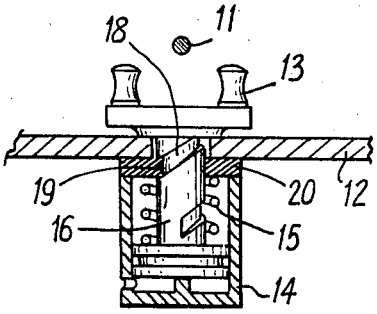
FIG. 4 is a schematic view in a rest position of a hydraulic jack controlling a twisting fork of a string.
Figure 5:
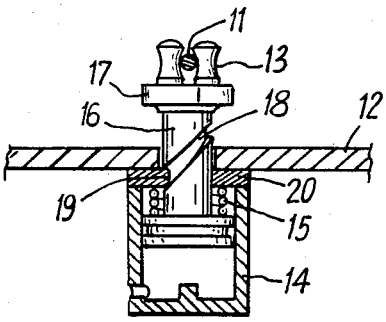
FIG. 5 corresponds to FIG. 4 with the fork in an active position.
Figure 6:
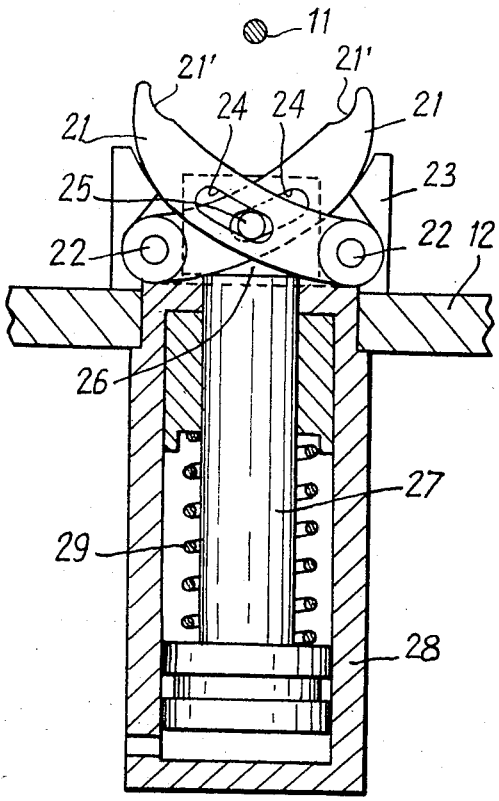
FIG. 6 is a schematic view of a preferential embodiment of a string pinching clamp, in a rest position.
Figure 7:
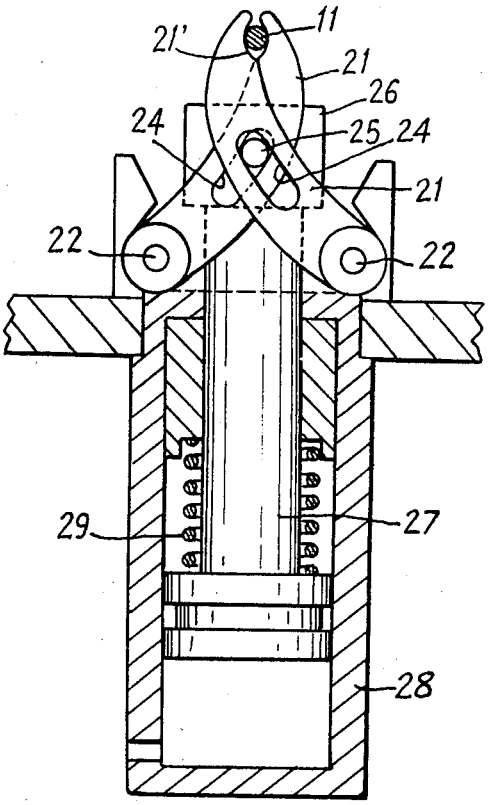
FIG. 7 is a view corresponding to FIG. 6 of the same clamp, in an active position.

In the embodiment of FIGS. 4 and 5, the immobilization device of the string is a two pronged fork 13, similar to the standard fork which is driven in rotation in order to create a twist on the string. However, in this embodiment, the fork is simultaneously turned and moved in the direction of the string so that in the inactive position shown in FIG. 4, the prongs of the fork 13 are remote from the string, thereby reducing the "zincking" risks. This movement is obtained, from the single acting hydraulic jack 14 with return to the rest position by a spring 15, by providing the jack rod 16 which carries the base plate 17 of the fork with a helical groove 18 in which is engaged a helical tooth 19 carried by the jack cover plate 20. When pressure is sent to the micro-jack 14, the fork moves while rotating in order to twist string 11 with a force which is a function of the slope of groove 18, of the jack section and of the hydraulic pressure used.

In the embodiments of FIGS. 6 through 9, string 11 is not twisted but pinched. In that of FIGS. 6 and 7, two jaws 21 are articulated at 22 on a base part 23 fixed to plate 12 such that the two jaw clamping notches 21' of string 11 are on either side of string 11 the articulation point 22 of each jaw being beyond the longitudinal plane containing the string so that the jaws intersect themselves by being superimposed along the axial plane. The two jaws are each formed with an oblong opening 24 along their longitudinal direction, said openings intersecting in the axial plane. In the two openings is engaged a stud 25 carried by a head 26 rigidly connected to the rod 27 of the piston of micro-jack 28 which is a single acting jack with a return spring 29. When there is no pressure, spring 29 retracts the piston rod to the position shown in FIG. 6, the clamping notches 21' being widely clear from string 11. When the pressure is established in the jack, the stud 25, when moving, brings the jaws 21 toward each other until they come to bear against the string, the clamping force being all the higher that the openings form at that moment a very acute angle with the axial plane, the jack force being multiplied by a cam effect.

Figure 8:
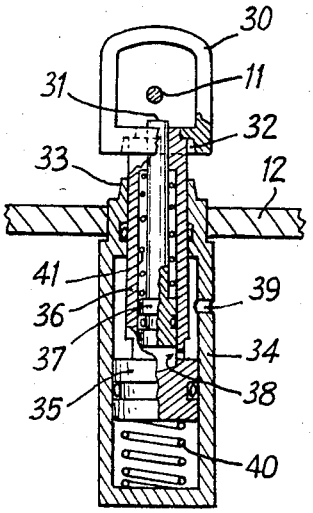
FIG. 8 is a schematic view in a rest position of a hydraulic jack controlling a pinching device with a window and pusher-piece.
Figure 9:
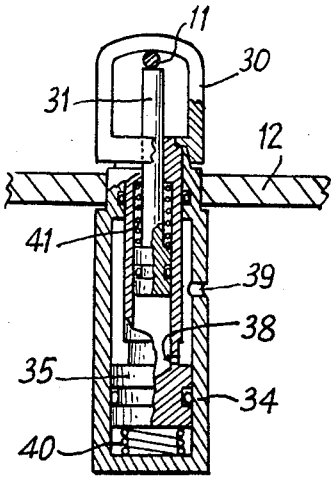
FIG. 9 is a corresponding schematic view, in an active position.

The embodiment of FIGS. 8 and 9 uses the blockage of string 11 in a position modified by a window 30, with which cooperates a pusher-piece 31. In this embodiment, the window 30 is, for blocking the string (FIG. 9) moved toward plate 12 in order to come to bear via its transverse branch on the string while the pusher-piece 31 is displaced in the reverse direction for strongly pinching the string against said transverse branch. The window 30 is on the other hand blocked at the end of its stroke by a conical cavity 32 surrounding its control stem fitting onto a frustoconical protrusion 33 connected to plate 12. The displacements in reverse directions of window 30 and of the pusher-piece 31 are provided by a double acting hydraulic jack 34. Said jack includes a main piston 35 the stem 36 of which is rigidly connected to the window 30. Stem 36 is axially bored in order to form the cylinder of the second piston 37 the stem of which forms the pusherpiece 31. The chamber of the cylinder which is above piston 35 communicates with the chamber below piston 37 via one or several ports 38 extending through the hollow piston stem 36 in the vicinity of piston 35. The chamber of jack 34 situated above piston 35 is fed via a connection 39 and the pistons are returned toward each other in order to move the transverse branch of window 30 away from the pusher-piece 31 and to free the string by means of springs 40 and 41. When the pressure is applied via the connection 39, piston 35 is pushed downwardly against the action of spring 40 the force of which is such, relative to that of spring 41, and taking in account the sections of pistons 35 and 37, that window 30 first moves down and then comes to fit onto the frustoconical base 33, following which the pusher-piece 31 comes to bear on string 11.

I claim:

1. A concert harp comprising a frame, a plurality of strings carried by said frame, and means for shortening the vibrating length of said strings in order to set up the tuned note of said string, said means comprising for each string two jaws movable in a direction transverse to the string toward and away from the string to clamp the string between the jaws, a hydraulic pressure actuated micro-jack having means operable on said jaws, and means mechanically connected with said two jaws for moving said two jaws in said direction by said operable means.

2. A harp as claimed in claim 1, and a source of hydraulic pressure, a conduit that extends through said frame from said source to said hydraulic micro-jack for transmitting the hydraulic pressure, and control means to control the transmission of the hydraulic pressure from said source to said micro-jack.

3. A harp as claimed in claim 2, in which said conduit and said control means are common to a plurality of said micro-jacks for moving the jaws associated with the strings of a same note of a musical scale.

4. A harp as claimed in claim 3, in which said control means are performer-actuated pedals carried by the frame.

5. A harp as claimed in claim 3, comprising a distributor acting as said control means for controlling the transmission of the hydraulic pressure from said source to said micro-jacks and a plurality of selectively manipulable actuators for said distributor.

6. A harp as claimed in claim 3, comprising a distributor acting as said control means for controlling the transmission of the hydraulic pressure from said source to said micro-jacks, and a programmable computer that controls said distributor and control means operable by a performer to program said computer.

7. A concert harp comprising a frame, a plurality of strings carried by said frame, and means for shortening the vibrating length of said strings in order to set up the tuned note of said string, said means comprising for each string two jaws movable in a direction transverse to the string toward and away from the string to clamp the string between the jaws, a hydraulic pressure actuated microjack, means mechanically connected with said two jaws for moving said two jaws in said direction, and means mounting said jaws for pivotal movement about their ends remote from the string, said hydraulic micro-jacks comprising a piston rod pivotally and slidingly connected with the jaws at a point intermediate the ends of the jaws and movable toward and away from the string to open and close the jaws.

8. A harp as claimed in claim 7, in which the piston rod is pivotally and slidingly connected with the jaws through each jaw having an oblong opening therein, the piston rod carrying a pin disposed in both of said oblong openings of said two jaws for simultaneously oppositely swinging said jaws.

9. A harp as claimed in claim 7, and a source of hydraulic pressure, a conduit that extends through said frame from said source to said hydraulic micro-jack for transmitting the hydraulic pressure, and control means to control the transmission of the hydraulic pressure from said source to said micro-jack.

10. A harp as claimed in claim 9, in which said conduit and said control means are common to a plurality of said micro-jacks for moving the jaws associated with the strings of a same note of a musical scale.

11. A harp as claimed in claim 10, in which said control means are performer-actuated pedals carried by the frame.

12. A harp as claimed in claim 10, comprising a distributor acting as said control means for controlling the transmission of the hydraulic pressure from said source to said micro-jacks and a plurality of selectively manipulable actuators for said distributor.

13. A harp as claimed in claim 10, comprising a distributor acting as said control means for controlling the transmission of the hydraulic pressure from said source to said micro-jacks, and a programmable computer that controls said distributor and control means operable by a performer to program said computer.

14. A harp as claimed in claim 1, said means mechanically connected with said two jaws comprising a shaft perpendicular to the strings, said jaws being rigidly mounted on said shaft, means mounting said shaft for axial spiral movement toward and away from the strings, and fluid pressure means for effecting said spiral movement of the shaft.

* * * * * *